US008882884B2

(12) United States Patent
Woodson et al.

(10) Patent No.: US 8,882,884 B2
(45) Date of Patent: Nov. 11, 2014

(54) SYSTEMS AND METHODS FOR OPTIMIZING A PAC RATIO

(75) Inventors: Damon Woodson, Macon, GA (US); Brandon Looney, Birmingham, AL (US)

(73) Assignee: Southern Company, Atlanta, GA (US)

( * ) Notice: Subject to any disclaimer, the term of this patent is extended or adjusted under 35 U.S.C. 154(b) by 653 days.

(21) Appl. No.: 13/248,614

(22) Filed: Sep. 29, 2011

(65) Prior Publication Data

US 2012/0073433 A1 Mar. 29, 2012

Related U.S. Application Data

(60) Provisional application No. 61/387,847, filed on Sep. 29, 2010.

(51) Int. Cl.
*B03C 3/34* (2006.01)
*B03C 3/68* (2006.01)

(52) U.S. Cl.
CPC ..... *B03C 3/68* (2013.01); *B03C 2201/24* (2013.01); *B03C 2201/32* (2013.01)
USPC ..... 95/3; 95/57; 95/58; 95/70; 96/19; 96/408

(58) Field of Classification Search
CPC ..... B03C 3/68; B03C 3/017; B03C 3/019; B03C 3/36; B03C 3/88; B03C 3/763; B03C 2201/24; B03C 2201/32; B03C 9/00; B01D 57/02; B01D 53/10; B01D 53/12; B01D 53/14; B01D 53/18; B01D 53/025; B01D 15/00; B01D 15/02; B01D 39/00
USPC ..... 95/3, 57, 58, 70; 96/19, 408
See application file for complete search history.

(56) References Cited

U.S. PATENT DOCUMENTS

| | | | | |
|---|---|---|---|---|
| 4,284,417 | A * | 8/1981 | Reese et al. | 95/3 |
| 5,321,274 | A * | 6/1994 | Yeh et al. | 250/573 |
| 6,953,494 | B2 * | 10/2005 | Nelson, Jr. | 95/134 |
| 7,081,152 | B2 * | 7/2006 | Altman et al. | 95/5 |
| 7,141,091 | B2 * | 11/2006 | Chang | 95/58 |
| 7,887,618 | B2 * | 2/2011 | Nelson | 95/58 |
| 8,080,088 | B1 * | 12/2011 | Srinivasachar | 95/107 |
| 8,167,975 | B2 * | 5/2012 | Shimamura et al. | 95/13 |
| 2005/0178265 | A1 * | 8/2005 | Altman et al. | 95/2 |
| 2007/0265161 | A1 * | 11/2007 | Gadkaree et al. | 502/417 |
| 2008/0286183 | A1 * | 11/2008 | Radway | 423/212 |
| 2010/0071348 | A1 * | 3/2010 | Kobayashi et al. | 60/276 |
| 2010/0074817 | A1 * | 3/2010 | Kobayashi et al. | 423/239.1 |
| 2010/0116126 | A1 * | 5/2010 | Shimamura et al. | 95/3 |

* cited by examiner

*Primary Examiner* — Robert A Hopkins
*Assistant Examiner* — Sonji Turner
(74) *Attorney, Agent, or Firm* — Troutman Sanders, LLP; Ryan A. Schneider; Dustin B. Weeks

(57) ABSTRACT

An exemplary embodiment of the present invention provides a method of controlling a PAC-to-particulate ratio in a potion of an exhaust system from a furnace. The method comprises measuring a second amount of particulate exiting a particulate removal system, and controlling a first amount of particulate removed by the particulate removal system based in part on the measured second amount of particulate, such that a desired ratio of PAC-to-particulate is obtained in the portion of the exhaust system.

13 Claims, 2 Drawing Sheets

SYSTEMS AND METHODS FOR OPTIMIZING A PAC RATIO

CROSS-REFERENCE TO RELATED APPLICATIONS

This application claims the benefit of U.S. Provisional Application Ser. No. 61/387,847, filed on 29 Sep. 2010, which is incorporated herein by reference in its entirety as if fully set forth below.

TECHNICAL FIELD OF THE INVENTION

The various embodiments of the present disclosure relate generally to systems and methods for optimizing a ratio of powdered activated carbon ("PAC") used to bind with an unwanted species. More particularly, exemplary embodiments of the present invention are directed to systems and methods for controlling a PAC-to-particulate ratio to optimize mercury capture in an exhaust.

BACKGROUND OF THE INVENTION

Conventionally, coal-fired furnaces for fossil fuel power plants require coal and air as their input. In the furnace, the coal is burned and creates an exhaust, which comprises a gas and particulate. The gas portion of the exhaust is commonly composed of about 78% nitrogen, about 15% carbon dioxide, about 3% oxygen, and about 4% various oxides made during combustion. The particulate portion of the exhaust comprises ash, which includes minerals other than carbon that will not combust into a gas form, and soot, which is unburned carbon or carbon formed from incomplete combustion. As the exhaust exits the furnace, most of the gas is invisible while most of the particulate is visible. Almost all coal-fired power plants are required under state law to capture most of the visible particulates.

In many coal-fired power generation plants, the primary device used to capture the particulates is called an electrostatic precipitator. In operation, the electrostatic precipitator provides a large negative electric field on wires or rods, and this field negatively charges the ash and soot particles. The negatively-charged particles are then electrostatically attracted to grounded or positively-charged plates in the precipitator, commonly called collector plates. As the negatively-charged particles travel through the precipitator, they magnetically attach to the grounded or positively-charged collector plates. Eventually, these particles can be collected in hoppers for landfill disposal, rather than being released into the atmosphere. In operation, the precipitator prevents large black plumes from exiting stacks of a power plant.

Mercury can enter the furnace by piggybacking on the coal. Hence, the exhaust gas can contain a small percentage of mercury. For example, the amount of mercury is about one to two pounds in about 10,000 tons of coal. The heat of the furnace transforms the mercury to its gaseous state, which is not visible due to its concentration level in the parts per trillion. Recently passed laws and regulations, e.g. the Utility MACT, have placed strict requirements on the amount of mercury that can be emitted into the atmosphere from the boilers of coal-fired electric power generation plants, as well as other industrial plants. Thus, power generation companies have invested billions of dollars in developing new technologies for capturing mercury, and other unwanted species, in the flue gases emitted from power plants.

One such technology involves injecting finely ground PAC into the exhaust from the boiler once the exhaust passes through the precipitator. PAC is a sorbent and can adsorb and absorb a majority of mercury that would otherwise be exhausted into the atmosphere. After the PAC is injected into the exhaust, the exhaust is passed through a baghouse that serves as a large filter to remove the PAC, thus removing a portion of the mercury. Conventionally, injection rates of about 1.5 to about 5 pounds of PAC per million cubic feet per minute of furnace gas are needed to control approximately 90% of the mercury output.

Unfortunately, the amount of mercury removed from the exhaust is not linearly related to the amount of PAC injected into the exhaust. Specifically, increasing the amount of PAC injected into the exhaust does not necessarily lead to the same increase in the amount of mercury removed from the exhaust. This phenomenon is thought to be a result of the complex mechanisms involved in adsorption. It is essential that the PAC remain in contact with the flue gas for a sufficient amount of time to increase the probability of capture, and thus increase the portion of the unwanted species removed. The PAC, however, cannot remain in the flue gas beyond the time where its affective adsorption capacity has been spent. For this reason one must have close control of the dust cake formation and removal within the filter device.

Therefore, there is a desire for systems and methods for controlling the composition of the exhaust/PAC mixture to optimize the dust cake control within the filter. Various embodiments of the present invention address such a desire.

BRIEF SUMMARY OF THE INVENTION

The present invention relates to systems and methods for obtaining a desired ratio of PAC-to-particulate, such as ash, in a coal-fired furnace exhaust system. Many exemplary embodiments of the present invention can find uses in systems employing coal-fired furnaces or the exhaust systems of such furnaces. An exemplary system comprises a coal-fired furnace, a particulate removal system, a PAC injection system, and a PAC filtration system. When the coal-fired furnace burns coal, it can produce an exhaust comprising particulate, such as ash. The exhaust can exit the furnace and enter the particulate removal system where a first amount of the particulate is removed from the exhaust. The exhaust with the remaining particulate—a second amount of the particulate—can exit the particulate removal system via a duct. The PAC injection system can then inject particles of PAC into the exhaust with the remaining particulate, such that mercury within the exhaust can be absorbed or adsorbed by the particles of PAC. The exhaust comprising the second amount of the particulate and the particles of PAC can then enter the PAC filtration system where the PAC can be filtered before the exhaust is released into the atmosphere.

As discussed above, conventionally, increasing the amount of PAC injected into the exhaust does not proportionally increase the amount of mercury removed from the exhaust due in part to the inability to control the dust cake within the filter device. Therefore, in exemplary embodiments of the present invention, the particulate in the exhaust is used to improve the control of the dust cake containing the PAC particles. Specifically, various embodiments of the present invention provide systems and methods for controlling the ratio of PAC-to-particulate, such that mercury removal is optimized.

An exemplary embodiment of the present invention provides a method of controlling a PAC-to-particulate ratio in a portion of an exhaust system comprising measuring the second amount of particulate not removed by the particulate removal system, which exits the particulate removal system via the duct, and controlling the first amount of particulate removed by the particulate removal system based in part on the measured second amount of particulate not removed, such that a desired ratio of PAC-to-particulate is obtained in the portion of the exhaust system. In an exemplary embodiment of the present invention, the particulate removal system comprises an electrostatic precipitator. In some embodiments of the present invention, the step of controlling the first amount of the particulate removed from the exhaust comprises varying the magnitude of an electric charge applied to components within the electrostatic precipitator. In some embodiments of the present invention, the step of monitoring the second amount of the particulate comprises measuring an opacity in the duct through which the second amount of particulate exits the particulate removal system.

In various embodiments of the present invention, the desired ratio of PAC-to-particulate can be many different ratios. In an exemplary embodiment of the present invention, the desired ratio of PAC-to-particulate is about one part PAC to one part particulate. In another exemplary embodiment of the present invention, the desired ratio of PAC-to-particulate is about one part PAC to about one or more parts particulate. In some embodiments of the present invention, the particulate comprises ash.

In another exemplary embodiment of the present invention, a method of controlling the ratio of PAC-to-particulate comprises varying the magnitude of an electric field applied to components of an electrostatic precipitator to achieve a desired ratio of PAC-to-particulate in a particular location, wherein the magnitude of the electric field is varied based in part on the amount of the particulate in the exhaust when the exhaust exits the electrostatic precipitator.

Various embodiments of the present invention may be employed in systems for removing mercury from an exhaust. For example, as discussed above, many coal-fired power generation plants inject PAC into the exhaust, which binds with mercury in the exhaust. In exemplary embodiments of the present invention, by maintaining a desired ratio of PAC-to-particulate, such as ash, in the exhaust, the amount of PAC necessary to remove a particular amount of mercury is decreased. Thus, various embodiments of the present invention provide methods of controlling the ratio of PAC-to-particulate.

These and other aspects of the present invention are described in the Detailed Description of the Invention below and the accompanying figures. Other aspects and features of embodiments of the present invention will become apparent to those of ordinary skill in the art upon reviewing the following description of specific, exemplary embodiments of the present invention in concert with the figures. While features of the present invention may be discussed relative to certain embodiments and figures, all embodiments of the present invention can include one or more of the features discussed herein. While one or more embodiments may be discussed as having certain advantageous features, one or more of such features may also be used with the various embodiments of the invention discussed herein. In similar fashion, while exemplary embodiments may be discussed below as system or method embodiments, it is to be understood that such exemplary embodiments can be implemented in various devices, systems, and methods of the present invention.

BRIEF DESCRIPTION OF THE DRAWINGS

The following Detailed Description of the Invention is better understood when read in conjunction with the appended drawings. For the purposes of illustration, there is shown in the drawings exemplary embodiments, but the subject matter is not limited to the specific elements and instrumentalities disclosed.

DETAILED DESCRIPTION OF THE INVENTION

To facilitate an understanding of the principles and features of the present invention, various illustrative embodiments are explained below. In particular, the invention is described in the context of being systems and methods of controlling a ratio of PAC-to-particulate. Embodiments of the present invention may be applied to many systems employing the use of a coal-fired furnace. Additionally, many embodiments of the present invention find uses in systems and methods for removing/capturing mercury in an exhaust. For example, various embodiments of the present invention find applications in coal-fired power generation plants employing systems for removing/capturing mercury in the exhaust of a furnace. The various embodiments of the present invention are not limited, however, to use in coal-fired power generation systems. Instead, as those skilled in the art would appreciate, the various embodiments of the present invention may find applications in many systems where it is desirable to control a ratio of PAC-to-particulate.

The components described hereinafter as making up various elements of the invention are intended to be illustrative and not restrictive. Many suitable components or steps that would perform the same or similar functions as the components or steps described herein are intended to be embraced within the scope of the invention. Such other components or steps not described herein can include, but are not limited to, for example, similar components or steps that are developed after development of the invention.

Figure 1:
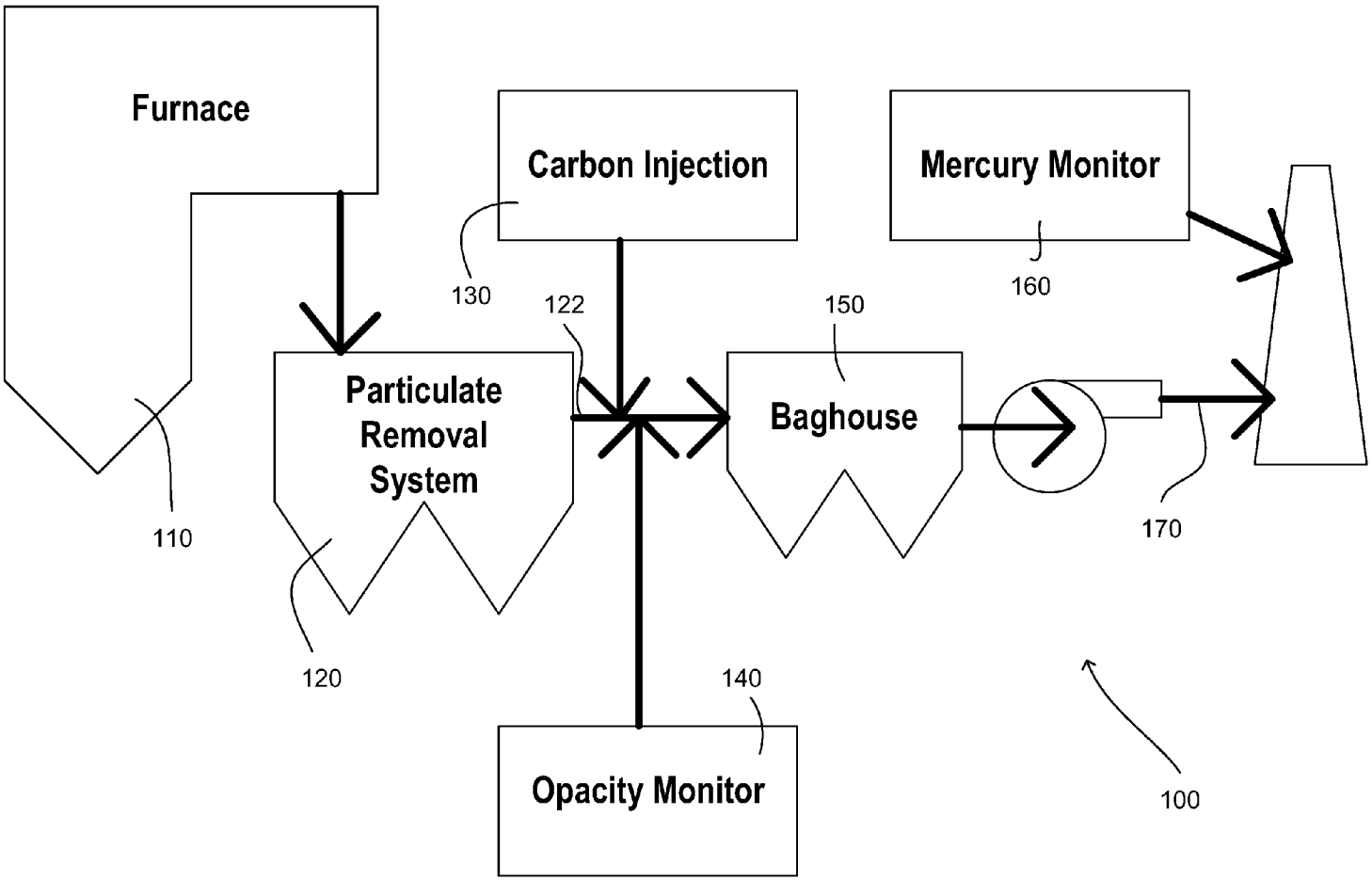
FIG. 1 illustrates a flow diagram of a portion of a power generation system, in accordance with an exemplary embodiment of the present invention.

FIG. 1 provides a flow chart for a furnace with an exhaust system 100 in accordance with an exemplary embodiment of the present invention. The exhaust system 100 comprises an electrostatic precipitator 120, a PAC injection system 130, and a baghouse 150. The furnace 110 burns a fuel, such as coal, and produces an exhaust. The exhaust can comprise a gas and particulate. The particulate can comprise many particles of minerals, which do not combust into gas form, and soot, which is unburned carbon or carbon formed from incomplete combustion.

The exhaust exits the furnace 110 and enters a particulate removal system, such as an electrostatic precipitator 120, where a portion of the particulate is removed from the exhaust. In embodiments of the present invention employing an electrostatic precipitator, a portion of the particulate is removed by inducing an electric field on components, such as plates or rods, of the electrostatic precipitator 120. This electric field induces a charge on the particles making up the particulate. The particles then can be magnetically attracted to oppositely charged components, such as collector plates, within the electrostatic precipitator 120. In some embodiments of the present invention, by varying the magnitude of the electric field applied to various components of the electrostatic precipitator 120, the amount of particulate removed from the exhaust by the electrostatic precipitator 120 can be controlled. For example, increasing the magnitude of the electric field applied to components of the precipitator 120 can increase the amount of particulate removed from the exhaust.

In some embodiments of the present invention, the particulate removal system does not remove all of the particulate in the exhaust, and thus, when the exhaust exits the particulate removal system 120, it comprises a second amount of particulate, which was not removed by the particulate removal system 120. After the exhaust comprising the second amount of particulate exits the particulate removal system 120 via a duct 122, it is injected with PAC by the PAC injection system 130. The PAC adsorbs and/or absorbs gaseous mercury, or other unwanted species, in the exhaust. The PAC, with mercury, can then be collected by a filtration system, such a baghouse 150, before the exhaust is released into the atmosphere through the output 170 of the exhaust system 100.

As discussed above, it is desirable to have a dust cake that can be well controlled within the filter device. Thus, in exemplary embodiments of the present invention, particulate in the exhaust from the furnace 110 is used to sufficiently condition the dust cake. In this sense, the particulate serves to fluff the PAC to prevent all of the particles of PAC from packing together. To ensure the PAC is sufficiently "fluffed" to optimize the efficiency of the PAC in capturing mercury, it is desired to achieve a desired ratio of PAC-to-particulate. Accordingly, exemplary embodiments of the present invention provide systems and methods for obtaining a desired ratio of PAC-to-particulate.

In some embodiments of the present invention, the amount of PAC injected into the exhaust can be easily calculated based on the speed of a feeder used to inject the PAC. Therefore, because the amount of PAC injected into the exhaust is known, some embodiments of the present invention control the ratio of PAC-to-particulate by varying the amount of particulate that exits the particulate removal system 120. The amount of particulate exiting the particulate removal system 120 is roughly equal to the amount of particulate exiting the furnace 110 minus the amount of particulate removed by the particulate removal system 120. The amount of particulate in the exhaust exiting a furnace 110 and entering a particulate removal system 120 can depend on many parameters, including, but not limited to, the temperature in the furnace 110, the quantity of fuel injected into the furnace 110, the type of fuel injected into the furnace 110, among others. In many cases, it is not desirable to change any of these parameters. For example, in a power generation plant, a furnace 110 may burn a specific type of coal at a specific temperature, but the amount of coal burned is dependent on a varying amount of electric power that must be produced according to a varying grid demand. Accordingly, in some embodiments of the present invention, the amount of particulate exiting the particulate removal system 120 is controlled by controlling the amount of particulate removed by particulate removal system 120.

An exemplary embodiment of the present invention provides a method of controlling the PAC-to-particulate ratio comprising measuring a second amount of the particulate exiting the particulate removal system 120, and controlling a first amount of particulate removed by the particulate removal system 120 base in part on the measured second amount of particulate exiting the particulate removal system 120. In an exemplary embodiment of the present invention, the step of measuring the second amount of particulate comprises measuring an opacity in a duct 122 through which the second amount of particulate exits the particulate removal system 120. In some embodiments of the present invention, the opacity in the duct 122 is indicative of the amount of particulate exiting the particulate removal system 120. The first amount of particulate removed by the particulate removal system 120 can be controlled many different ways known in the art. In an exemplary embodiment of the present invention, the step of controlling the first amount of particulate removed comprises varying the magnitude of an electric charge applied to components of an electrostatic precipitator 120.

The inventors of the present invention have discovered that, in some embodiments of the present invention, the optimal ratio of PAC-to-particulate is about one part PAC to one part particulate. Further, in some embodiments of the present invention, the optimal ratio of PAC-to-particulate is one part PAC to one or more parts particulate.

In some embodiments of the present invention, a precipitator energy management control system is employed to obtain the desired ratio of PAC-to-particulate. For example, the amount of particulate in the duct 122 exiting the electrostatic precipitator 120 can be estimated/measured using an opacity monitor 140. Based on a known PAC injection rate, a particular opacity measurement can indicate the specific amount of particulate exiting the precipitator 120, such that a specific ratio of PAC-to-particulate exists. For example, an opacity measurement of about 20% may be indicative of a PAC-to-particulate ratio of about one to one. Thus, the precipitator energy management control system may control the amount of particulate removed by the precipitator 120, such that the opacity monitor 140 will continue to read 20%. For example, if the opacity monitor 140 indicates an opacity measurement above 20%, which means too much particulate is exiting the precipitator 120, the energy management system may increase the power or magnitude of the electric charge applied to components of the precipitator 120 to remove more particulate from the exhaust, such that less particulate exits the precipitator 120. On the other hand, if the opacity monitor 140 indicates an opacity measurement below 20%, which means not enough particulate is exiting the precipitator 120, the energy management system may decrease the power or electric charge applied to components of the precipitator 120 to remove less particulate from the exhaust, such that more particulate exits the precipitator 120. The 20% opacity value discussed above is exemplary. As those skilled in the art will understand, the opacity value for a desired PAC-to-particulate ratio will vary in various embodiments of the present invention.

Various embodiments of the present invention may lead to decreases in the amount of PAC and electric power used by various systems. For example, a conventional mercury capture system in a coal-fired power generation plant has a precipitator outlet opacity of 5% and uses about 350 pounds of PAC per hour to capture about 90% of the mercury in the exhaust. When an exemplary embodiment of the present invention was employed, however, the system had a precipitator outlet opacity of about 20%, and used 175 pounds of PAC per hour to capture 90% of the mercury in the exhaust. Accordingly, because PAC typically costs about a dollar per pound, using the exemplary system saves about $175 per hour on that single system. Additionally, because the precipitator outlet opacity was changed from 5% to 20%, which means the precipitator was not required to remove as much particulate from the exhaust, the precipitator began using much less electric power. This reduced power saves about one dollar per MWhr of station load.

Figure 2:
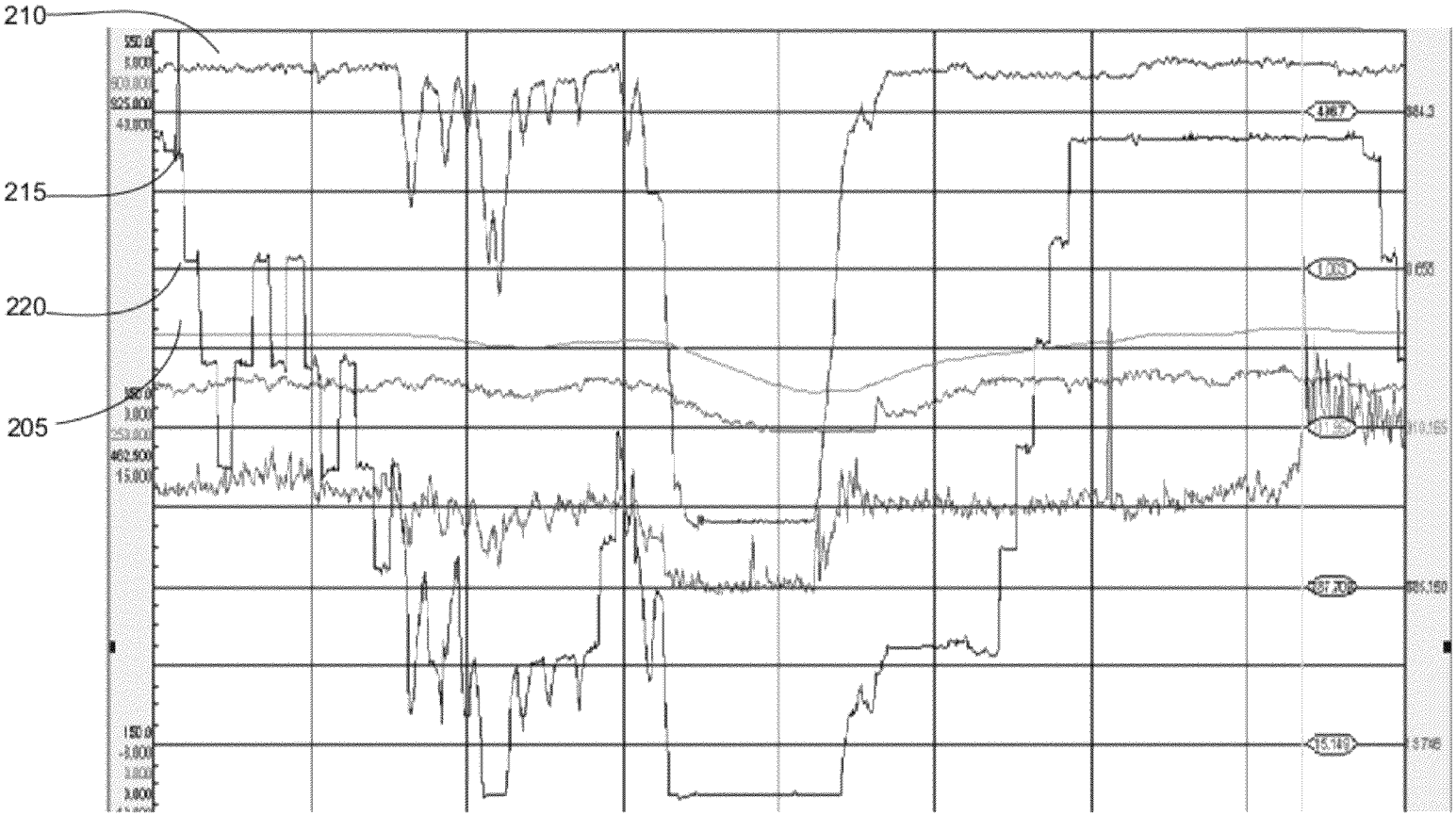
FIG. 2 illustrates a graphical representation of a ratio of PAC-to-particulate, in accordance with an exemplary embodiment of the present invention.

FIG. 2 illustrates a graphical representation of readings of embodiments of the present invention in a test case. As shown in FIG. 2, reference 205 shows the reading of an amount of ash that was increased in a baghouse while at a constant load 210. When the ash to PAC ratio increased, the rate of PAC injection 215 fell significantly, while the mercury capture 220 remained constant. This illustrates that by manipulating ash can save significant amounts of PAC. As mentioned, PAC currently costs about one dollar per pound, and using a proper ash to PAC ration can result in a significant savings on larger units.

It is to be understood that the embodiments and claims disclosed herein are not limited in their application to the details of construction and arrangement of the components set forth in the description and illustrated in the drawings. Rather, the description and the drawings provide examples of the embodiments envisioned. The embodiments and claims disclosed herein are further capable of other embodiments and of being practiced and carried out in various ways. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the claims be regarded as including such equivalent constructions.

Furthermore, the purpose of the foregoing Abstract is to enable the United States Patent and Trademark Office and the public generally, and especially including the practitioners in the art who are not familiar with patent and legal terms or phraseology, to determine quickly from a cursory inspection the nature and essence of the technical disclosure of the application. The Abstract is neither intended to define the claims of the application, nor is it intended to be limiting to the scope of the claims in any way. It is intended that the application is defined by the claims appended hereto.

What is claimed is:

1. In an furnace exhaust system for removing an exhaust from a furnace, the exhaust comprising particulate, the furnace exhaust system comprising a particulate removal system for removing a first amount of the particulate from the exhaust, such that a second amount of the particulate exits the particulate removal system through a duct, the exhaust system further comprising a PAC injection system for injecting PAC into the exhaust downstream of the particulate removal system, a method controlling a PAC-to-particulate ratio in a portion of the exhaust system downstream of the particulate removal system comprising:

measuring the second amount of the particulate remaining in the exhaust; and controlling the first amount of the particulate removed by the particulate removal system based in part on the measured second amount of particulate, wherein the step of controlling the first amount of the particulate provides a ratio of PAC-to-particulate in the portion of the exhaust system of about one part PAC to one or more parts particulate.

2. The method of claim 1, wherein the particulate removal system comprises an electrostatic precipitator.

3. The method of claim 2, wherein the step of controlling the first amount of the particulate comprises varying a magnitude of an electric charge applied to components within the electrostatic precipitator.

4. The method of claim 1, wherein the particulate comprises ash.

5. The method of claim 1, wherein the step of monitoring the second amount of the particulate comprises measuring an opacity in the duct through which the second amount of particulate exits the particulate removal system.

6. The method of claim 1, wherein the step of controlling the first amount of the particulate provides a ratio of PAC-to-particulate in the portion of the exhaust system of about one part PAC to one part particulate.

7. In a coal-fired power generation plant comprising a furnace, an electrostatic precipitator, a PAC injection system, and a PAC filtration system, wherein an exhaust comprising particulate exits the furnace and enters the electrostatic precipitator wherein a first amount of the particulate is removed from the exhaust before the remaining exhaust comprising a second amount of the particulate exits the electrostatic precipitator via a duct, wherein the PAC injection system injects PAC into the duct, such that at least a portion of the PAC comes into contact with at least a portion of the second amount of the particulate, wherein the exhaust comprising the second amount of particulate and the PAC enter the PAC filtration system, a method of controlling the ratio of PAC-to-particulate in a portion of the plant downstream of the electrostatic precipitator to optimize mercury removal comprising:

based in part on the second amount of the particulate exiting the electrostatic precipitator, varying the magnitude of an electric field applied to components of the electrostatic precipitator, wherein the step of varying the magnitude of the electric field applied to components of the electrostatic precipitator provides a ratio of one part PAC to one or more parts particulate.

8. The method of claim 7, further comprising measuring the second amount of the particulate exiting the electrostatic precipitator.

9. The method of claim 8, wherein the step of measuring the second amount of the particulate comprises measuring the opacity in the duct through which the second amount of particulate exits the electrostatic precipitator.

10. In a system for removing a second amount of mercury from an exhaust of coal-fired furnace, wherein the exhaust comprises a first amount of mercury and a first amount of particulate, wherein the system is configured to remove a second amount of the particulate from the exhaust, inject an amount of PAC into the exhaust having a remaining third amount of the particulate, such that the second amount of mercury is adsorbed or absorbed by the PAC, and filter the PAC from the exhaust, a method of reducing the amount of PAC used to remove the second amount of mercury comprising:

measuring the third amount of the particulate;

varying the second amount of the particulate removed from the exhaust based on the measured third amount of the particulate, wherein the step of varying the second amount of the particulate removed from the exhaust provides a ratio of PAC-to-particulate of one part PAC to one or more parts particulate.

11. The method of claim 10, wherein the step of measuring the third amount of the particulate comprises measuring the opacity in a duct through which the third amount of particulate passes.

12. The method of claim 10, wherein the step of varying the second amount of the particulate removed from the exhaust comprises varying the magnitude of the electric field applied to components of an electrostatic precipitator.

13. The method of claim 10, wherein the particulate comprises ash.

* * * * *